US011158233B2

(12) United States Patent
Ko

(10) Patent No.: US 11,158,233 B2
(45) Date of Patent: Oct. 26, 2021

(54) DISPLAY DEVICE AND METHOD FOR DRIVING THE SAME

(71) Applicant: SAMSUNG DISPLAY CO., LTD., Yongin-si (KR)

(72) Inventor: Seung Yong Ko, Yongin-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 16/715,358

(22) Filed: Dec. 16, 2019

(65) Prior Publication Data

US 2020/0320922 A1 Oct. 8, 2020

(30) Foreign Application Priority Data

Apr. 4, 2019 (KR) ..... 10-2019-0039779

(51) Int. Cl.

| | |
|---|---|
| ***G09G 5/10*** | (2006.01) |
| ***G09G 3/20*** | (2006.01) |
| ***G09G 3/3275*** | (2016.01) |
| ***G09G 3/3266*** | (2016.01) |

(52) U.S. Cl.

CPC ..... *G09G 3/2007* (2013.01); *G09G 3/3266* (2013.01); *G09G 3/3275* (2013.01); *G09G 2310/027* (2013.01); *G09G 2320/0233* (2013.01); *G09G 2320/0242* (2013.01); *G09G 2320/0626* (2013.01)

(58) Field of Classification Search

CPC ..... G09G 2310/027; G09G 2320/0233; G09G 2320/0242; G09G 2320/0626; G09G 3/2007; G09G 3/3266; G09G 3/3275

See application file for complete search history.

(56) References Cited

U.S. PATENT DOCUMENTS

2006/0267893 A1* 11/2006 Kim ..... G09G 3/3611 345/89
2008/0309600 A1* 12/2008 Lee ..... G09G 3/3648 345/89
2018/0025683 A1 1/2018 Oh et al.

FOREIGN PATENT DOCUMENTS

KR 10-2003-0090076 11/2003
KR 10-2018-0011434 2/2018

* cited by examiner

*Primary Examiner* — Insa Sadio
(74) *Attorney, Agent, or Firm* — F. Chau & Associates, LLC

(57) ABSTRACT

A display device includes a display panel including a pixel, and a panel driver configured to change a length of a gate-on period of a light emission control signal provided to the pixel in a current frame on the basis of a difference between a grayscale of a previous frame and a grayscale of the current frame.

17 Claims, 9 Drawing Sheets

| | (k-1)-th Frame | k-th Frame | (k+1)-th Frame | (k+2)-th Frame | (k+3)-th Frame |
|---|---|---|---|---|---|
| GR | 1 | 250 | 250 | 250 | 250 |
| DATA2 | 1 | 254 (CG) | 250 | 250 | 250 |
| DV (data voltage) | 6V (0nit) | 2V (400nit) | 3V (400nit) | 3V (400nit) | 3V (400nit) |

DISPLAY DEVICE AND METHOD FOR DRIVING THE SAME

CROSS-REFERENCE TO RELATED APPLICATION

This application claims priority under 35 U.S.C. § 119 to Korean Patent Application No. 10-2019-0039779, filed on Apr. 4, 2019 in the Korean Intellectual Property Office, the disclosure of which is incorporated by reference herein in its entirety.

TECHNICAL FIELD

Exemplary embodiments of the inventive concept relate to a display device, and more particularly, to a display device and a method of driving the same.

DISCUSSION OF RELATED ART

A display device may include red pixels for outputting red light, green pixels for outputting green light, and blue pixels for outputting blue light. A charging time required for charging a pixel may be different according to the color of the pixel, and the charging time decreases as a resolution of a display device increases. Therefore, when a grayscale (e.g., a data voltage) rapidly varies between successive frames, some pixels may have an insufficient light emission amount or fail to reach a desired luminance, thus causing a display defect such as screen drag or color blurring.

SUMMARY

According to an exemplary embodiment of the inventive concept, a display device includes a display panel including a pixel, and a panel driver configured to change a length of a gate-on period of a light emission control signal provided to the pixel in a current frame on the basis of a difference between a grayscale of a previous frame and a grayscale of the current frame.

In an exemplary embodiment of the inventive concept, the panel driver may include a light emission period controller configured to increase the length of the gate-on period of the light emission control signal provided to the current frame when a first grayscale difference is greater than a predetermined first reference value. The first grayscale difference is obtained by subtracting a previous average grayscale, which is an average of grayscales of an image of the previous frame, from a current average grayscale, which is an average of grayscales of an image of the current frame.

In an exemplary embodiment of the inventive concept, the current average grayscale and the previous average grayscale may be averages of grayscales corresponding to a k-th (where k is a natural number) pixel row.

In an exemplary embodiment of the inventive concept, the light emission period controller may determine the length of the gate-on period of the light emission control signal provided to each pixel row on the basis of the first grayscale difference of a respective pixel row.

In an exemplary embodiment of the inventive concept, in the same dimming luminance condition, the length of the gate-on period of the light emission control signal when the first grayscale difference may be greater than the predetermined first reference value is longer than the length of the gate-on period of the light emission control signal when the first grayscale difference is less than or equal to the predetermined first reference value.

In an exemplary embodiment of the inventive concept, the current average grayscale may be an average of all grayscales of the current frame, and the previous average grayscale may be an average of all grayscales of the previous frame.

In an exemplary embodiment of the inventive concept, the panel driver may further include a grayscale compensator configured to increase the grayscale of the current frame of the pixel to a compensation grayscale when a second grayscale difference is greater than a second reference value. The second grayscale difference is obtained by subtracting the grayscale of the previous frame of the pixel from the grayscale of the current frame.

In an exemplary embodiment of the inventive concept, when a driving transistor included in the pixel is a p-type transistor, a magnitude of a data voltage provided to the pixel in the current frame may decrease due to an increase of the grayscale of the current frame.

In an exemplary embodiment of the inventive concept, when the grayscale of the current frame is the same as a grayscale of a next frame, a data voltage provided to the pixel in the next frame may be greater than the data voltage provided to the pixel in the current frame.

In an exemplary embodiment of the inventive concept, when the second grayscale difference is greater than the predetermined second reference value, the grayscale compensator may apply a predetermined compensation coefficient to the grayscale of the current frame to increase the grayscale of the current frame.

In an exemplary embodiment of the inventive concept, the panel driver may include a data driver configured to generate a data voltage corresponding to a grayscale and provide the data voltage to the pixel, a scan driver configured to provide a scan signal to the pixel, and a light emission driver configured to provide the light emission control signal to the pixel.

According to an exemplary embodiment of the inventive concept, a display device includes a display panel including a pixel, and a panel driver configured to increase a grayscale corresponding to a current frame on the basis of a difference between a grayscale of a previous frame of the pixel and a grayscale of the current frame of the pixel.

In an exemplary embodiment of the inventive concept, the panel driver may include a grayscale compensator configured to increase the grayscale of the current frame when a first grayscale difference is greater than a predetermined first reference value. The first grayscale difference is obtained by subtracting the grayscale of the previous frame of the pixel from the grayscale of the current frame of the pixel.

In an exemplary embodiment of the inventive concept, when a driving transistor included in the pixel is a p-type transistor, a magnitude of a data voltage provided to the pixel in the current frame may decrease according to an increase of the grayscale of the current frame.

In an exemplary embodiment of the inventive concept, the panel driver may include a light emission period controller configured to increase a length of a gate-on period of a light emission control signal provided to the pixel in the current frame when a second grayscale difference is greater than a predetermined second reference value. The second grayscale difference is obtained by subtracting a previous average grayscale, which is an average of grayscales of an image of the previous frame, from a current average grayscale, which is an average of grayscales of an image of the current frame.

In an exemplary embodiment of the inventive concept, in the same dimming luminance condition, the length of the gate-on period of the light emission control signal when the second grayscale difference is greater than the predetermined second reference value may be longer than the length of the gate-on period of the light emission control signal when the second grayscale difference is less than or equal to the predetermined second reference value.

According to an exemplary embodiment of the inventive concept, a method of driving a display device includes comparing a grayscale of a previous frame with a grayscale of a current frame, and increasing a length of a gate-on period of a light emission control signal provided to the current frame when a first increase amount of an average grayscale of an image of the current frame with respect to an average grayscale of an image of the previous frame is greater than a predetermined first reference value.

In an exemplary embodiment of the inventive concept, the average grayscale of the image of the current frame and the average grayscale of the image of the previous frame may be averages of grayscales corresponding to a k-th (where k is a natural number) pixel row.

In an exemplary embodiment of the inventive concept, the method may further include increasing a grayscale of the current frame of a target pixel when a second increase amount of the grayscale of the current frame of the target pixel with respect to a grayscale of the previous frame of the target pixel is greater than a predetermined second reference value, and providing a data voltage corresponding to the increased grayscale to the target pixel in the current frame.

In an exemplary embodiment of the inventive concept, the increased grayscale may be a compensation grayscale that is constant regardless of a value of the second increase amount.

BRIEF DESCRIPTION OF THE DRAWINGS

The above and other features of the inventive concept will become more apparent by describing in further detail exemplary embodiments thereof with reference to the accompanying drawings.

DETAILED DESCRIPTION OF THE EMBODIMENTS

Figure 1:
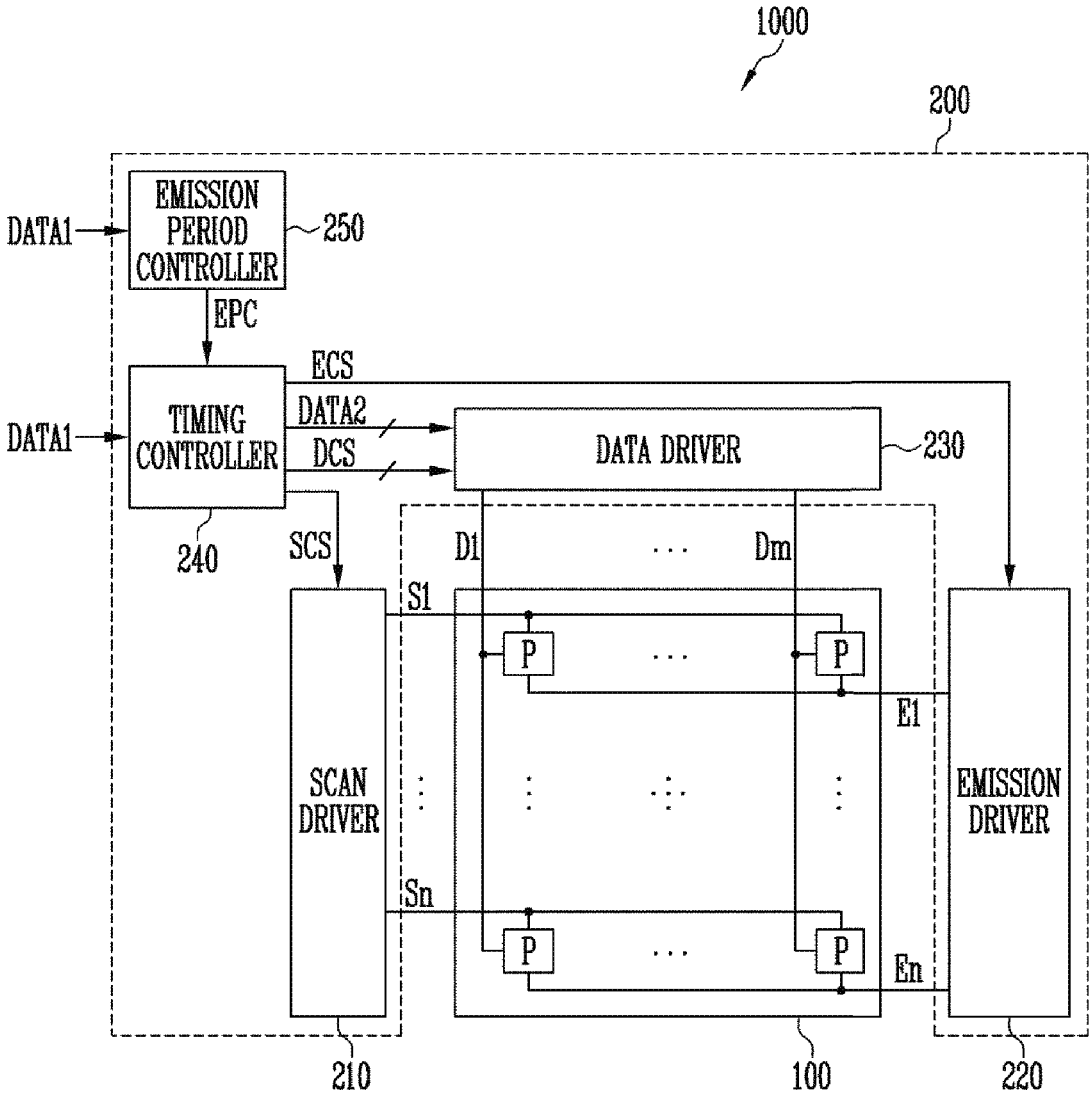
FIG. 1 is a block diagram illustrating a display device according to an exemplary embodiment of the inventive concept.

Exemplary embodiments of the inventive concept provide a display device and a method of driving the same that adjust a gate-on period of an emission control signal of a current frame on the basis of a grayscale difference of successive frames.

Exemplary embodiments of the inventive concept also provide a display device and a method of driving the same that compensate a grayscale of a current frame on the basis of a grayscale difference of successive frames.

Hereinafter, exemplary embodiments of the inventive concept will be described in detail with reference to the accompanying drawings. Like reference numerals may refer to like elements throughout this application.

FIG. 1 is a block diagram illustrating a display device according to an exemplary embodiment of the inventive concept.

Referring to FIG. 1, a display device 1000 may include a display panel 100 and a panel driver 200.

The display device 1000 may be a flat display device, a flexible display device, a curved display device, a foldable display device, or a bendable display device. In addition, the display device 1000 may be applied to a transparent display device, a head-mounted display device, a wearable display device, or the like.

The display panel 100 may include a plurality of scan lines S1 to Sn, a plurality of light emission control lines E1 to En, a plurality of data lines D1 to Dm, and a plurality of pixels P connected to the scan lines S1 to Sn, light emission control lines E1 to En, and the data lines D1 to Dn (where each of m and n is an integer greater than 1).

Each of the pixels P may include a driving transistor and a plurality of switching transistors.

The panel driver 200 may change a length of a gate-on period of a light emission control signal provided to a current frame on the basis of a difference between a grayscale of a previous frame and a grayscale of the current frame.

In an exemplary embodiment of the inventive concept, the panel driver 200 may provide scan signals, light emission control signals, and data signals to the pixels P. In an exemplary embodiment of the inventive concept, the panel driver 200 may include a scan driver 210 for providing the scan signal, a light emission driver 220 for providing the light emission control signal, a data driver 230 for providing the data signal, and a timing controller 240 for controlling driving of the scan driver 210, the light emission driver 220, and the data driver 230. The panel driver 200 may further include a light emission period controller 250.

The scan driver 210 may provide the scan signals to the scan lines S1 to Sn on the basis of a first control signal SCS. In an exemplary embodiment of the inventive concept, the scan driver 210 may substantially simultaneously provide the scan signals (e.g., scan signals having a gate-on level) to all the pixels P, or may sequentially provide the scan signals to the display panel 100 in units of pixel rows.

The light emission driver 220 may provide the light emission control signals to the light emission control lines E1 to En on the basis of a second control signal ECS. In an exemplary embodiment of the inventive concept, the light emission driver 220 may substantially simultaneously provide the light emission control signals to all the pixels P, or may sequentially provide the light emission control signals to the display panel 100 in units of pixel rows.

The data driver 230 may provide the data signals (data voltages) to the data lines D1 to Dm on the basis of a third control signal DCS and image data DATA2 provided from the timing controller 240. For example, the data driver 230 may convert the image data DATA2 of a digital format into data signals of an analog format, and provide the data signals to the pixels P through the data lines D1 to Dm. The image data DATA2 includes grayscale values corresponding to each of the pixels P.

The timing controller 240 may receive input image data (e.g., an RGB image signal), a vertical synchronization signal, a horizontal synchronization signal, a main clock signal, a data enable signal, or the like from an external graphic controller, and generate the first to third control signals SCS, ECS, and DCS and the image data DATA2 on the basis of such signals. In an exemplary embodiment of the inventive concept, the timing controller 240 may adjust the second control signal ECS on the basis of a light emission period control signal EPC provided from the light emission period controller 250. For example, the second control signal ECS includes a light emission control start signal, and the length of the gate-on period of the light emission control start signal may be adjusted by the light emission period control signal EPC.

In an exemplary embodiment of the inventive concept, when a grayscale difference obtained by subtracting a previous average grayscale, which is an average of the grayscales of the image of the previous frame, from a current average grayscale, which is an average of the grayscales of the image of the current frame, is greater than a set or predetermined reference value, the light emission period controller 250 may increase the length of the gate-on period of the light emission control signal provided to the current frame. The light emission period controller 250 may control the length of the gate-on period of the light emission control signal provided to all the pixel rows for one frame equally. Alternatively, the light emission period controller 250 may control the length of the gate-on period of the light emission control signal provided to some pixel rows differently from the length of the gate-on period of the light emission control signal provided to the other pixel rows.

The light emission period controller 250 may receive input image data DATA1 and detect a grayscale change between successive frames using the input image data DATA1. When the grayscale change is greater than the predetermined reference value, the length of the gate-on period of the light emission control signal of the current frame may be increased.

In general, when the image is changed from a low grayscale image (for example, a black image) to a high grayscale image (for example, a white image), a magnitude of a driving current for light emission of a light emitting device included in the pixel P is rapidly increased. However, when the image is changed from a low grayscale to a high grayscale, a charging time for charging a high driving current into the light emitting device (e.g., a light emitting capacitor of the light emitting device) becomes insufficient, resulting in luminance reduction and color blurring. Particularly, when a screen switch from a previous image to a current image occurs with a rapid grayscale change, step efficiency, which is a ratio of a luminance immediately after the screen switch (e.g., an actual luminance of a first frame after the screen switch) to a target luminance (e.g., an ideal luminance) of the current image, is decreased.

The light emission period controller 250 may increase the light emission period (e.g., the gate-on period of the light emission control signal) corresponding to the first frame at the time when the image is changed from the low grayscale to the high grayscale. Therefore, since the charging time of the light emitting device, at the time when the image is changed from the low grayscale to the high grayscale by a screen scrolling or the like, is increased, the image grayscale conversion efficiency and the step efficiency may be improved. Thus, luminance reduction, image distortion, and color blurring due to the rapid image change may be minimized.

Figure 2:
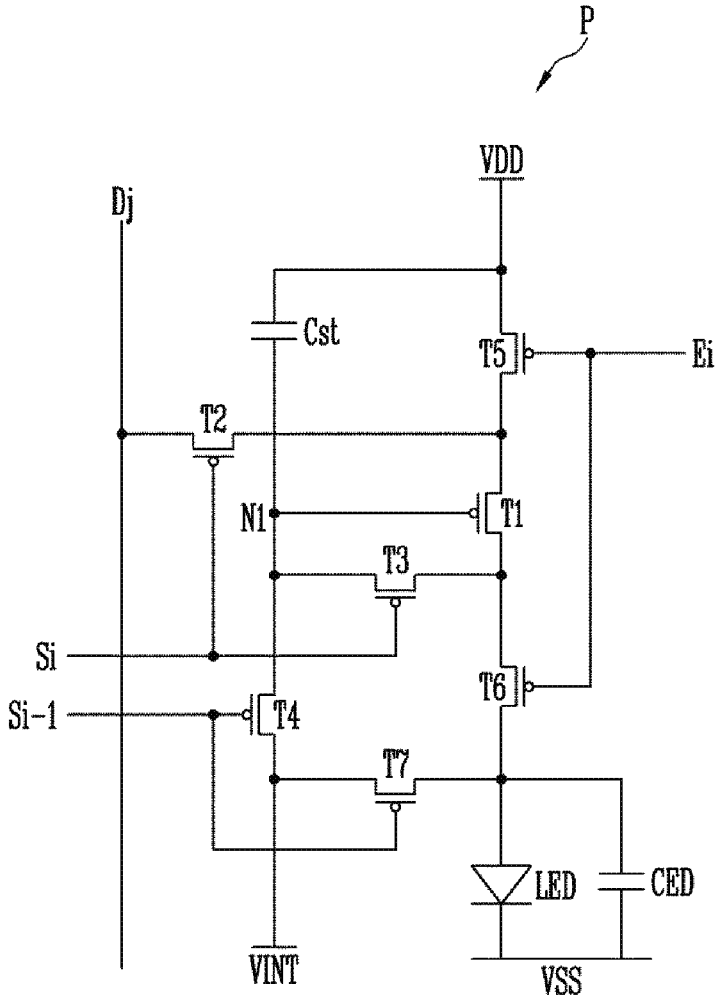
FIG. 2 is a circuit diagram illustrating a pixel included in the display device of FIG. 1 according to an exemplary embodiment of the inventive concept.

FIG. 2 is a circuit diagram illustrating a pixel included in the display device of FIG. 1 according to an exemplary embodiment of the inventive concept.

Referring to FIGS. 1 and 2, the pixel P may include first to seventh transistors T1 to T7, a light emitting device LED, and a storage capacitor Cst. Here, the pixel P is a pixel disposed at a j-th column (where j is a natural number) and an i-th row (where i is a natural number greater than 1).

In addition, although the first to seventh transistors T1 to T7 are illustrated as p-type transistors in FIG. 2, configurations of the first to seventh transistors T1 to T7 are not limited thereto. For example, at least one of the first to seventh transistors T1 to T7 may be an n-type transistor.

The first transistor T1 may be electrically coupled between a first power VDD and the light emitting device LED. The first transistor T1 may include a gate electrode coupled to a first node N1. The first transistor T1 may determine the magnitude of the driving current flowing to the light emitting device LED according to a magnitude of the data voltage (data signal).

The second transistor T2 is a scan transistor for transferring the data voltage to the pixel P in response to the scan signal provided to an i-th scan line Si. The second transistor T2 may be coupled between a j-th data line Dj and a first electrode of the first transistor T1. A gate electrode of the second transistor T2 may be connected to the i-th scan line Si.

The third transistor T3 may perform data voltage writing and threshold voltage compensation for the first transistor T1. The third transistor T3 may be coupled between a second electrode of the first transistor T1 and the first node N1. A gate electrode of the third transistor T3 may be connected to the i-th scan line Si. When the second transistor T2 and the third transistor T3 are turned on by the scan signal, the first transistor T1 is diode-connected and the threshold voltage compensation of the first transistor T1 may be performed.

The fourth transistor T4 may be coupled between the first node N1 and a conductive line for transferring an initialization power VINT. The fourth transistor T4 may include a gate electrode connected to an (i−1)-th scan line Si−1. When the fourth transistor T4 is turned on, a voltage of the initialization power VINT may be provided to the gate electrode of the first transistor T1. For example, the voltage of the initialization power VINT may be an initialization voltage for initializing a gate voltage of the first transistor T1.

The fifth transistor T5 may be coupled between a power line for transferring the first power VDD and the first electrode of the first transistor T1. The fifth transistor T5 may include a gate electrode connected to an i-th light emission control line Ei.

The sixth transistor T6 may be coupled between the second electrode of the first transistor T1 and a first electrode (e.g., an anode) of the light emitting device LED. The sixth transistor T6 may include a gate electrode connected to the i-th light emission control line Ei.

The fifth and sixth transistors T5 and T6 may be turned on in response to the light emission control signal. The driving current may be provided to the light emitting device LED by turning on the fifth and sixth transistors T5 and T6. The light emitting device LED may emit light at a grayscale corresponding to the driving current.

The seventh transistor T7 may be coupled between the first electrode of the light emitting device and the conductive line for transferring the initialization power VINT. The seventh transistor T7 may include a gate electrode connected to the (i−1)-th scan line Si−1. When the seventh transistor T7 is turned on, the voltage of the initialization power VINT may be transferred to the first electrode of the light emitting device LED.

The light emitting device LED may be connected between a second electrode of the sixth transistor T6 and a second power VSS. In an exemplary embodiment of the inventive concept, the first power VDD may have a voltage greater than that of the second power VSS. The light emitting device LED may be an organic light emitting diode including an organic light emitting layer. However, this is only an example, and the light emitting device LED may be an inorganic light emitting device, or a light emitting device that emits light using a quantum dot effect.

The light emitting device LED may emit light corresponding to the driving current generated by the first transistor T1. In an exemplary embodiment of the inventive concept, the pixel P may further include a light emitting capacitor CED connected to the light emitting device LED in parallel. The light emitting device LED may emit light on the basis of a charge amount (or current) charged in the light emitting capacitor CED. As the grayscale increases, the magnitude of the driving current increases. When the image changes from the low grayscale to the high grayscale, the charge amount charged in the light emitting capacitor CED may be rapidly increased. In this case, the luminance of the light emitting device LED may be reduced to charge the light emitting capacitor CED.

The display device 1000 according to exemplary embodiments of the inventive concept may improve an image quality defect generated when the image is rapidly changed from a relatively low grayscale to a high grayscale, by securing the charging time of the light emitting capacitor CED or including a configuration for fast charging.

Figure 3:
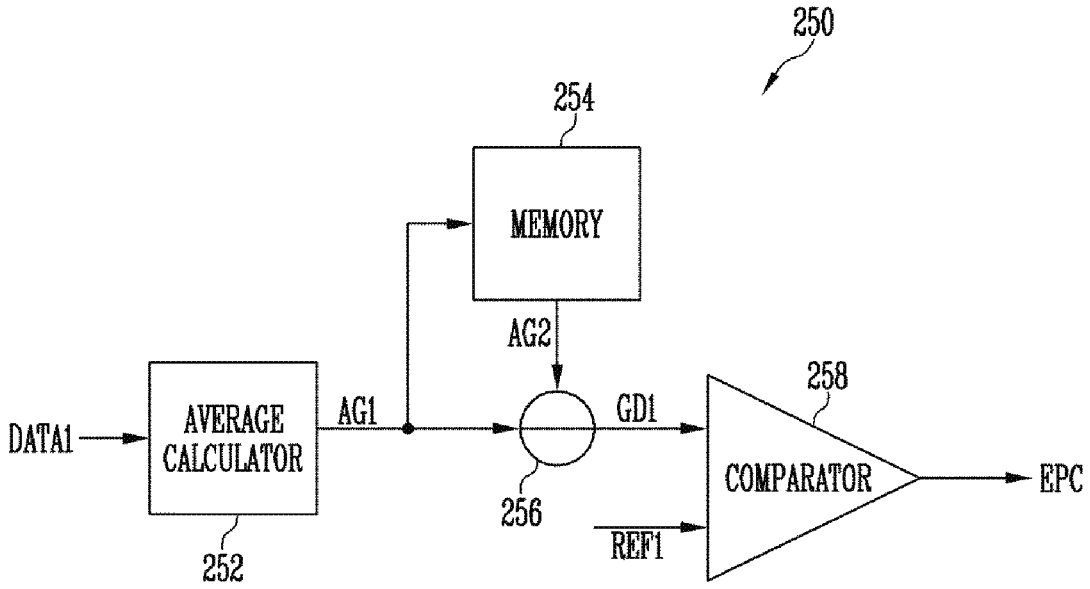
FIG. 3 is a diagram illustrating a light emission period controller included in the display device of FIG. 1 according to an exemplary embodiment of the inventive concept.

FIG. 3 is a diagram illustrating a light emission period controller included in the display device of FIG. 1 according to an exemplary embodiment of the inventive concept.

Referring to FIGS. 1 to 3, the light emission period controller 250 may adjust the length of the gate-on period of the light emission control signal of the current frame on the basis of the difference of the grayscale of the previous frame and the grayscale of the current frame.

The light emission period controller 250 may output the light emission period control signal EPC for determining the length of the gate-on period of the light emission control signal.

In an exemplary embodiment of the inventive concept, the light emission period controller 250 may include an average calculator 252, a memory 254, a subtractor 256, and a comparator 258.

The average calculator 252 may receive the input image data DATA1 corresponding to the image of the current frame and calculate the average of the grayscale of a corresponding pixel row or the entire image. The average calculator 252 may provide a current average grayscale AG1, which is the average of the grayscales of the current frame, to each of the memory 254 and the subtractor 256.

In an exemplary embodiment of the inventive concept, the average calculator 252 may calculate the grayscale average of the entire input image data DATA1 of one frame. For example, the average calculator 252 may calculate the current average grayscale AG1 of the entire input image data DATA1 using a sum of all the grayscale values of the input image data DATA1. In this case, a light emission control signal having a length of one gate-on period may be provided to each of the pixel rows (e.g., the light emission control lines E1 to En) during one frame.

In an exemplary embodiment of the inventive concept, the average calculator 252 may calculate the current average grayscale AG1 for each pixel row. The average calculator 252 may calculate the current average grayscale AG1 using the sum of the grayscale values corresponding to one pixel row. For example, when the display panel 100 includes n pixel rows, the average calculator 252 may calculate n current average grayscales AG1. In this case, the length of the gate-on period of the light emission control signal may be independently determined for each pixel row.

The memory 254 may store the current average grayscale AG1 output from the average calculator 252 during one frame period. The average grayscale output from the memory 254 may be a previous average grayscale AG2 that is the average grayscale of the previous frame. The memory 254 may provide the previous average grayscale AG2 to the subtractor 256.

The subtractor 256 may subtract the previous average grayscale AG2 from the current average grayscale AG1 (e.g., AG1−AG2). A result obtained by subtracting the previous average grayscale AG2 from the current average grayscale AG1 may be output as a first grayscale difference GD1. According to an exemplary embodiment of the inventive concept, the first grayscale difference GD1 may be output only when the current average grayscale AG1 is greater than the previous average grayscale AG2. In other words, the first grayscale difference GD1 may be output when the image is converted from the low grayscale image to the high grayscale image.

The first grayscale difference GD1 may be a grayscale difference of the entire image or a grayscale difference of each pixel row. The first grayscale difference GD1 may be provided to the comparator 258.

The comparator 258 may compare the first grayscale difference GD1 with a predetermined first reference value REF1 to output the light emission period control signal EPC. The first reference value REF1 may be a reference for determining whether the image converted between the successive frames is the image of which the grayscale is rapidly increased. For example, when the display panel 100 is implemented so that 256 grayscales may be expressed from 0 grayscale to 255 grayscale, the first reference value REF1 may be set to 245 grayscales. In other words, when the first grayscale difference GD1 is greater than 245 grayscales, the light emission period control signal EPC may be output.

For example, when the previous average grayscale AG2 is 2 grayscales and the current average grayscale AG1 is 248 grayscales, the first grayscale difference GD1 is 246 grayscales and the comparator 258 may output the light emission control signal EPC. However, when the previous average grayscale AG2 is 248 grayscales and the current average grayscale AG1 is 2 grayscales, the comparator 258 does not output the light emission control signal EPC.

However, this is only an example, and the first reference value REF1 is not limited thereto. The first reference value REF1 may be set to an optimal value according to a characteristic of the display panel 100 and the pixels P.

The light emission period control signal EPC may control the length of a light emission period (e.g., the gate-on period) of the light emission control signal.

A setting value of the gate-on period of the light emission control signal may be stored in the display device 1000 according to a dimming luminance (dimming level). The light emission driver 220 may output the light emission control signal having the gate-on period of a predetermined length according to the dimming luminance. The light emission period control signal EPC may increase the gate-on period of the light emission control signal of one frame under a corresponding dimming luminance condition.

In the same dimming luminance condition, the length of the gate-on period of the light emission control signal when the first grayscale difference GD1 is greater than the first reference value REF1 may be longer than the length of the gate-on period of the light emission control signal when the first grayscale difference GD1 is less than or equal to the first reference value REF1. For example, in the same dimming luminance condition, the length of the gate-on period of the light emission control signal may be increased within a range of about 5% to about 50% in response to the light emission period control signal EPC, as compared with the length of the gate-on period of the light emission control signal without the light emission period control signal EPC.

According to an exemplary embodiment of the inventive concept, an increase rate of a light emission period length may be set differently according to the dimming luminance. Alternatively, the increase rate of the light emission period length may be adjusted according to a magnitude of a deviation between the first grayscale difference GD1 and the first reference value REF1. For example, as the deviation between the first grayscale difference GD1 and the first reference value REF1 increases, the increase rate of the light emission period length may increase.

Accordingly, when the image is converted from the low grayscale to the high grayscale (for example, when the black image is changed to the white image), the charging time of the light emitting capacitor CED may be sufficiently secured by increasing the gate-on period of the light emission control signal. Therefore, a display defect such as luminance reduction and color blurring due to the rapid image change may be minimized or reduced.

Figure 4A:
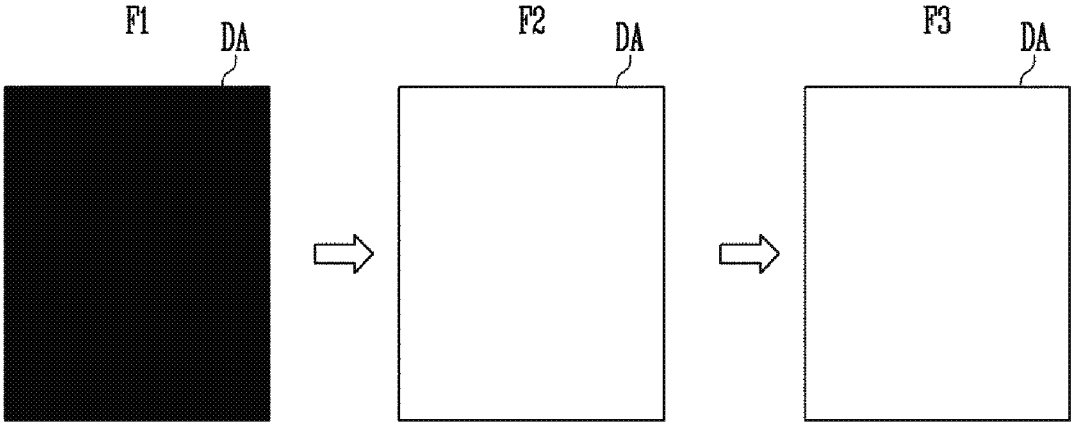
FIG. 4A is a diagram illustrating a change of an image displayed on the display device of FIG. 1 according to an exemplary embodiment of the inventive concept.
Figure 4B:
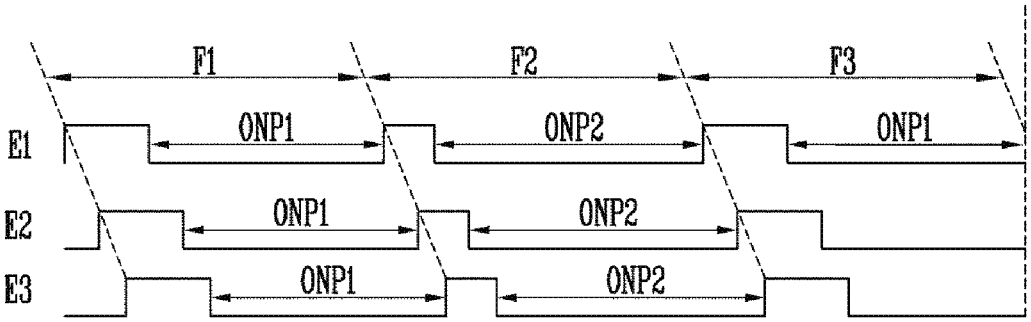
FIG. 4B is a waveform diagram illustrating a light emission control signal output according to the image change of FIG. 4A according to an exemplary embodiment of the inventive concept.

FIG. 4A is a diagram illustrating a change of an image displayed on the display device of FIG. 1 according to an exemplary embodiment of the inventive concept, and FIG. 4B is a waveform diagram illustrating a light emission control signal output according to the image change of FIG. 4A according to an exemplary embodiment of the inventive concept.

Referring to FIGS. 1 to 4B, the length of the gate-on period of the light emission control signal may be controlled according to the image change.

As shown in FIG. 4A, the image displayed in the display area DA of the display panel 100 during first to third frames F1 to F3 may be changed. The image of the first frame F1 may be the low grayscale image (for example, the black image), and the images of the second frame F2 and the third frame F3 may be the high grayscale images (for example, the white images).

In an exemplary embodiment of the inventive concept, the light emission period controller 250 may output the light emission period control signal EPC on the basis of the average of all the grayscales of the previous frame and the average of all the grayscales of the current frame.

Here, the first grayscale difference GD1 between the first frame F1 and the second frame F2 is greater than the first reference value REF1 and the first grayscale difference GD1 between the second frame F2 and the third frame F3 is less than the first reference value REF1. Therefore, the length of the gate-on period of the light emission control signal provided to the second frame F2 may be increased.

In FIG. 4B, the light emission control signal is sequentially provided to the light emission control lines E1, E2, and E3 every frame. Although FIG. 4B shows that the light emission control signals are provided to the first to third light emission control lines E1, E2, and E3, the light emission control signals may be sequentially provided up to the n-th emission control line (En of FIG. 1).

The gate-on period of the light emission control signal provided to the first frame F1 may have a first width ONP1. The gate-on period of the light emission control signal provided to the second frame F2 during which the grayscale is rapidly changed from the low grayscale to the high grayscale may have a second width ONP2. Here, the second width ONP2 may be set to be longer than the first width ONP1. The gate-on period of the light emission control signal may have the first width ONP1 again during the third frame F3 during which the grayscale similar to that of the second frame F2 is displayed. Thereafter, the gate-on period of the light emission control signal is not increased even though the high grayscale image is continuously displayed.

In other words, since the second width ONP2 of the second frame F2, during which the grayscale is rapidly changed from the low grayscale to the high grayscale, is set to be longer than the first width ONP1, the charging time of the light emitting device LED (or the charging time of the light emitting capacitor CED) may be secured. Therefore, display defects such as luminance reduction and image distortion, due to a decrease of a charging rate when the grayscale (and the data voltage) is rapidly increased, may be minimized.

Figure 5A:
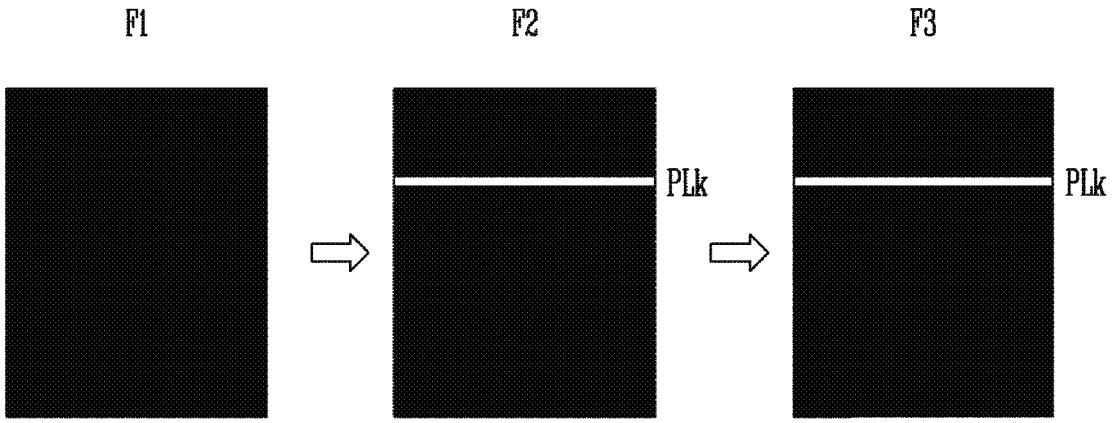
FIG. 5A is a diagram illustrating a change of the image displayed on the display device of FIG. 1 according to an exemplary embodiment of the inventive concept.
Figure 5B:
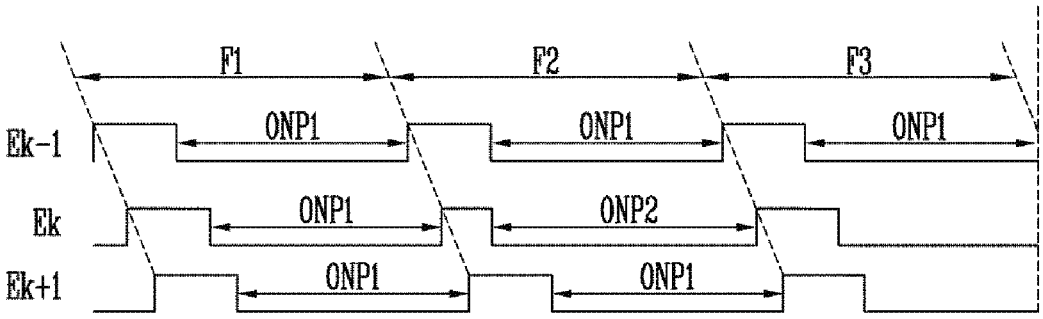
FIG. 5B is a waveform diagram illustrating the light emission control signal output according to the image change of FIG. 5A according to an exemplary embodiment of the inventive concept.

FIG. 5A is a diagram illustrating a change of the image displayed on the display device of FIG. 1 according to an exemplary embodiment of the inventive concept, and FIG. 5B is a waveform diagram illustrating the light emission control signal output according to the image change of FIG. 5A according to an exemplary embodiment of the inventive concept.

Referring to FIGS. 1 to 5B, the length of the gate-on period of the light emission control signal may be controlled according to the image change.

In an exemplary embodiment of the inventive concept, each of the current average grayscale AG1 and the previous average grayscale AG2 may be the average of the grayscales corresponding to the i-th (where i is a natural number less than or equal to n) pixel row. In other words, in the exemplary embodiment of FIGS. 5A and 5B, the length of the gate-on period of the light emission control signal may be controlled for each pixel row.

As shown in FIG. 5A, the image displayed in the display area DA of the display panel 100 during the first to third frames F1 to F3 may be changed. The image of the first frame F1 is the low grayscale image (for example, the black image), and the images of the second frame F2 and the third frame F3 may include the high grayscale images on a k-th pixel row PLk.

Here, the first grayscale difference GD1 of the k-th pixel row PLk between the first frame F1 and the second frame F2 is greater than the first reference value REF1 and the first grayscale difference GD1 of each of all the pixel rows between the second frame F2 and the third frame F3 is less than the first reference value REF1. Therefore, the length of the gate-on period of the light emission control signal provided to the k-th pixel row PLk in the second frame F2 may be increased.

FIG. 5B illustrates the light emission control signals provided to (k−1)-th to (k+1)-th emission control lines Ek−1, Ek, and Ek+1. The light emission control signal having the gate-on period of the first width ONP1 may be sequentially applied to the (k−1)-th to (k+1)-th emission control lines Ek−1, Ek, and Ek+1 in the first frame F1.

The gate-on period of the light emission control signal provided to the k-th light emission control line Ek in the second frame F2 may have the second width ONP2. In other words, since the grayscale of the image displayed on the k-th pixel row PLk in the second frame F2 is rapidly increased, the width of the gate-on period of the light emission control signal may be increased. On the other hand, the light emission control signal having the gate-on period of the first width ONP1 may be applied to the (k−1)-th and (k+1)-th light emission control lines Ek−1 and Ek+1 in the second frame F2.

As described above, the display device according to the exemplary embodiment of FIGS. 5A and 5B may control the width of the gate-on period of the light emission control signal for each of the pixel rows (or emission control lines).

Figure 6:
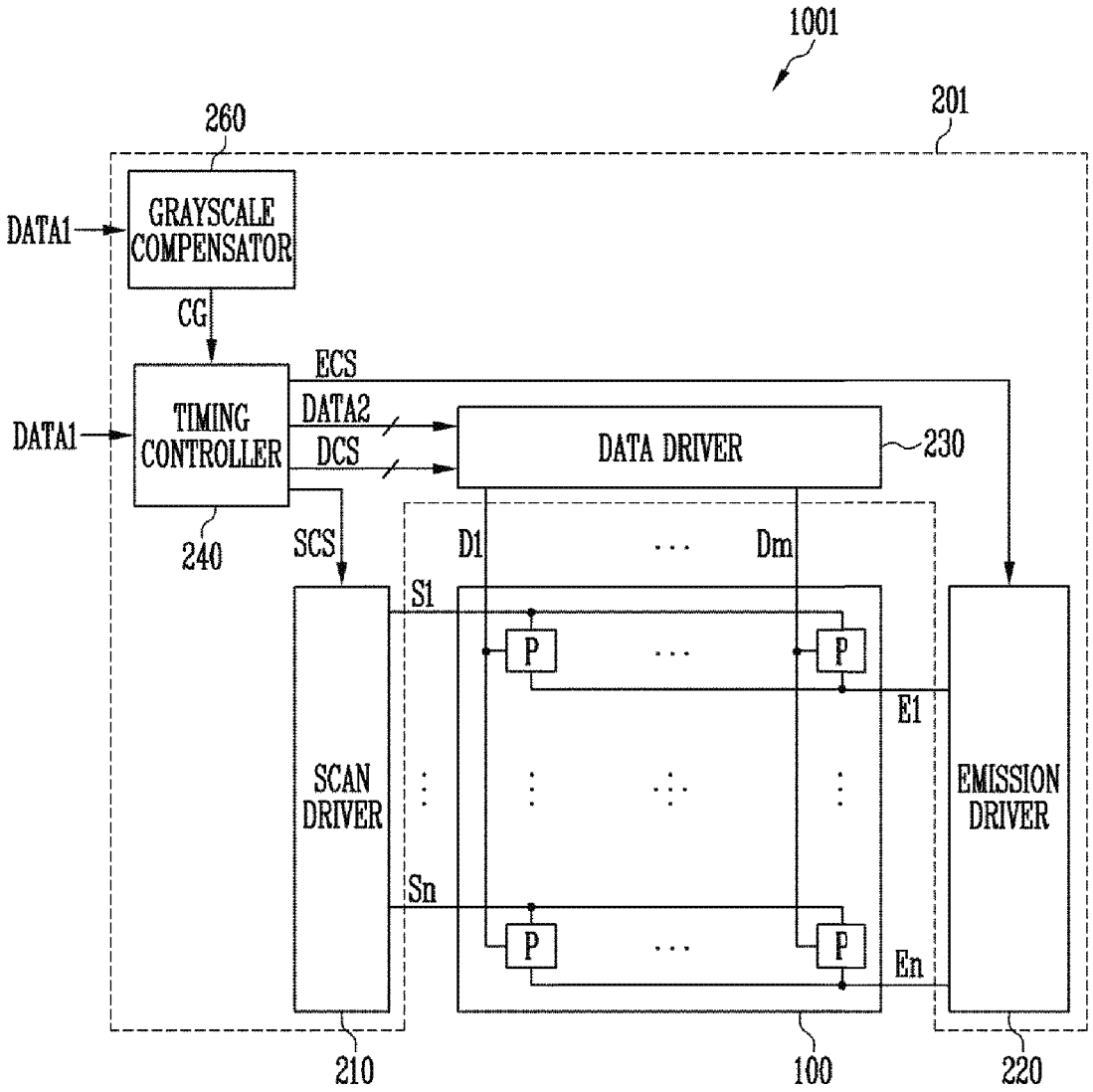
FIG. 6 is a block diagram illustrating a display device according to an exemplary embodiment of the inventive concept.

FIG. 6 is a block diagram illustrating a display device according to an exemplary embodiment of the inventive concept.

In FIG. 6, the same reference numerals are used for the configuration elements described with reference to FIG. 1, and repetitive descriptions of these configuration elements will be omitted. In addition, the display device of FIG. 6 may have substantially the same or similar configuration as the display device 1000 of FIG. 1 except for including a grayscale compensator instead of a light emission period controller.

Referring to FIGS. 1 and 6, a display device 1001 may include the display panel 100 and a panel driver 201.

The panel driver 201 may increase the grayscale corresponding to the current frame on the basis of the difference between the grayscale of the previous frame and the grayscale of the current frame.

In an exemplary embodiment of the inventive concept, the panel driver 201 may include the scan driver 210, the light emission driver 220, the data driver 230, the timing controller 240, and a grayscale compensator 260.

When a second grayscale difference obtained by subtracting the grayscale of the previous frame corresponding to a target pixel from the grayscale of the current frame corresponding to the target pixel is greater than a predetermined second reference value, the grayscale compensator 260 may increase the grayscale of the current frame for the target pixel to a compensation grayscale CG. The grayscale of the input image data DATA1 corresponding to the target pixel may be replaced with the compensation grayscale CG. The data driver 230 may provide a data voltage corresponding to the compensation grayscale CG to the target pixel.

For example, the compensation grayscale CG may be determined by applying a predetermined compensation coefficient to the grayscale of the input image data DATA1 of the current frame. The compensation grayscale CG may be greater than the grayscale of the input image data DATA1 of the current frame.

In an exemplary embodiment of the inventive concept, when the driving transistor (for example, the first transistor T1 in FIG. 2) included in the pixel P is a p-type transistor, the magnitude of the data voltage provided to the pixel P may be decreased due to an increase of the grayscale of the current frame. Accordingly, the magnitude of the driving current provided to the light emitting device LED may be increased. Therefore, a sufficient charging time of the light-emitting capacitor CED may be secured at the time of the rapid image conversion from the low grayscale to the high grayscale.

However, this is only an example, and when the driving transistor included in the pixel P is an n-type transistor, the magnitude of the data voltage provided to the pixel P in the current frame may be increased according to the increase of the grayscale of the current frame.

Figures 7, 8:
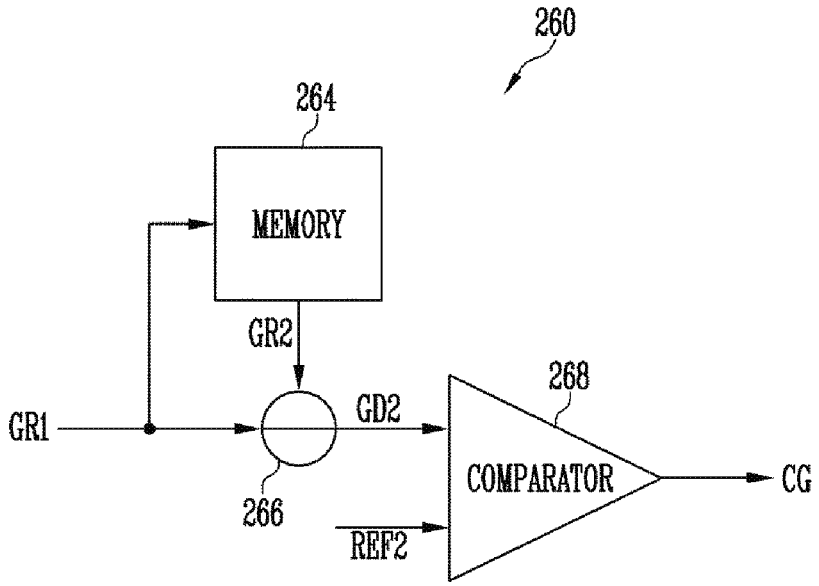
FIG. 7 is a diagram illustrating a grayscale compensator included in the display device of FIG. 6 according to an exemplary embodiment of the inventive concept.
FIG. 8 is a diagram illustrating an operation of the grayscale compensator of FIG. 7 according to an exemplary embodiment of the inventive concept.

FIG. 7 is a diagram illustrating a grayscale compensator included in the display device of FIG. 6 according to an exemplary embodiment of the inventive concept.

Referring to FIGS. 6 and 7, the grayscale compensator 260 may include a memory 264, a subtractor 266, and a comparator 268.

In an exemplary embodiment of the inventive concept, the grayscale compensator 260 may determine whether or not to perform compensation for each of the pixels P. In an exemplary embodiment of the inventive concept, the grayscale compensator 260 may determine whether or not to perform the compensation in units of pixel blocks on the basis of the average grayscale calculated in units of predetermined pixel blocks.

FIG. 7 illustrates an example of a method of determining whether or not to perform the compensation on the grayscale (e.g., an input grayscale) of a predetermined target pixel. The input image data DATA1 may be provided to the memory 264 and the subtractor 266. For example, a grayscale (e.g., a first grayscale GR1) of the current frame of the target pixel may be provided to the memory 264 and the subtractor 266.

The memory 264 may store the first grayscale GR1 during one frame period. The memory 264 may provide a grayscale (e.g., a second grayscale GR2) of the previous frame to the subtractor 266.

The subtractor 266 may calculate a difference between the first grayscale GR1 and the second grayscale GR2 corresponding to the target pixel. The subtractor 266 may subtract the second grayscale from the first grayscale GR1 (e.g., GR1−GR2). A subtraction result may be output as a second grayscale difference GD2. According to an exemplary embodiment of the inventive concept, the second grayscale difference GD2 may be output only when the first grayscale GR1 is greater than the second grayscale GR2. In other words, the second grayscale difference GD2 may be output when the image is converted from the low grayscale image to the high grayscale image.

The second grayscale difference GD2 may be a grayscale difference of the target pixel. The second grayscale difference GD2 may be provided to the comparator 268.

The comparator 268 may output the compensation grayscale CG by comparing the second grayscale difference GD2 with a predetermined second reference value REF2. The second reference value REF2 may be a reference for determining whether the image converted between the successive frames is an image of which the grayscale is rapidly increased. For example, when the display panel 100 is implemented so that 256 grayscales may be expressed from 0 grayscale to 255 grayscale, the second reference value REF2 may be set to 245 grayscales. In other words, when the second grayscale difference GD2 is greater than 245 grayscales, the first grayscale GR1 (the grayscale of the current frame) may be compensated.

According to an exemplary embodiment of the inventive concept, the first grayscale GR1 is converted into the compensation grayscale CG. The compensation grayscale CG may have a value greater than the first grayscale GR1. In an exemplary embodiment of the inventive concept, the compensation grayscale CG may have a constant value regardless of the second grayscale difference GD2. In other words, when the second grayscale difference GD2 is greater than the second reference value REF2, the first grayscale GR1 may be converted to a constant compensation grayscale CG to quickly charge the light emitting capacitor CED.

However, this is only an example, and the compensation grayscale CG may be varied according to the magnitude of the second grayscale difference GD2 and/or the first grayscale GR1. For example, the greater the second grayscale difference GD2 and/or the first grayscale GR1, the greater the compensation grayscale CG may be. For example, the grayscale compensator 260 may output the compensation grayscale CG by applying a predetermined compensation coefficient to the second grayscale difference GD2. The compensation grayscale CG may be derived from the following Equation 1.

$$CG=GR1+C*(GR1-GR2) \quad \text{[Equation 1]}$$

Here, C may be a compensation coefficient determined by an experiment or the like.

As described above, when the image is converted from the low grayscale to the high grayscale (for example, when the black image is changed to the white image), the grayscale value is increased, and thus the light emitting capacitor CED may be quickly charged. Therefore, display defects such as luminance reduction and color blurring due to the rapid image change may be minimized.

FIG. 8 is a diagram illustrating an operation of the grayscale compensator of FIG. 7 according to an exemplary embodiment of the inventive concept.

Referring to FIGS. 2 and 6 to 8, the image data DATA2 provided to the data driver 230 may be compensated according to a grayscale change of the target pixel.

A grayscale GR of the input image data DATA1 corresponding to the target pixel may be 1 grayscale in the (k−1)-th frame and may be 250 grayscales in the k-th to (k+3)-th frames. In other words, the grayscale GR of the target pixel in the k-th frame may be rapidly increased.

For example, the grayscale difference of the target pixel between the (k−1)-th frame and the k-th frame may be greater than the second reference value REF2. In this case, the grayscale compensator 260 may compensate the grayscale GR of the k-th frame of the target pixel to the compensation grayscale CG. For example, the compensation grayscale CG may be 254 grayscales.

The data driver 230 may convert the image data DATA2 into a data voltage DV. As shown in FIG. 8, the data voltage DV corresponding to the compensation grayscale CG may be less than the data voltage DV corresponding to the grayscale of the (k+1)-th frame. In other words, a magnitude of the data voltage DV provided to the k-th frame may be less than the magnitude of the data voltage DV provided to the (k+1)-th frame with respect to the same grayscale GR of the input image data DATA1.

Therefore, when the image is converted from the low grayscale to the high grayscale (for example, when the black image is changed to the white image), the driving current is increased by the increase of the grayscale value of the first frame (the current frame or the k-th frame), and the light emission capacitor CED may be quickly charged. Thus, the grayscale conversion efficiency and the step efficiency of the image may be improved.

Thereafter, the grayscale GR of the input image data DATA1 may be determined as the image data DATA2 provided to the data driver 230 as it is in the (k+1)-th to (k+3)-th frames.

Figure 9:
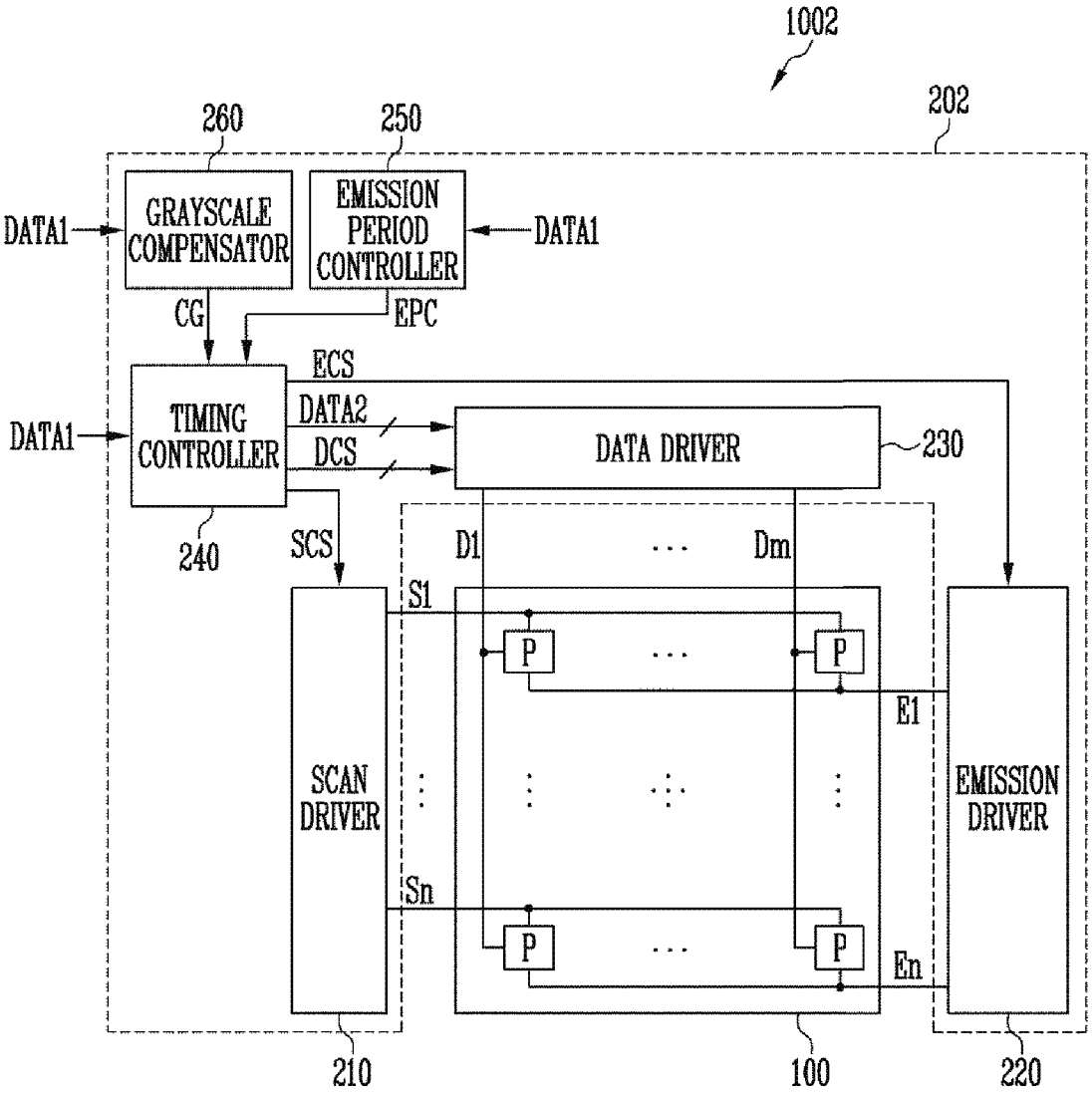
FIG. 9 is a block diagram illustrating a display device according to an exemplary embodiment of the inventive concept.

FIG. 9 is a block diagram illustrating a display device according to an exemplary embodiment of the inventive concept.

In FIG. 9, the same reference numerals are used for the configuration elements described with reference to FIGS. 1 and 6, and repetitive descriptions of these configuration elements will be omitted.

Referring to FIG. 9, a display device 1002 may include the display panel 100 and a panel driver 202.

The panel driver 202 may increase the length of the gate-on period of the light emission control signal provided to the current frame on the basis of the difference between the grayscale of the previous frame and the grayscale of the current frame. In addition, the panel driver 202 may increase the grayscale corresponding to the current frame on the basis of the difference between the grayscale of the previous frame and the grayscale of the current frame.

The panel driver 202 may include the scan driver 210 for providing the scan signal, the light emission driver 220 for providing the light emission control signal, the data driver 230 for providing the data signal, the timing controller 240 for controlling the driving of the scan driver 210, the light emission driver 220, and the data driver 230. The panel driver 200 may further include the light emission period controller 250 and the grayscale compensator 260.

The configuration and the operation of the light emission period controller 250 and the grayscale compensator 260 have been described above with reference to FIGS. 3 to 8, and thus repetitive descriptions will be omitted.

Figure 10:
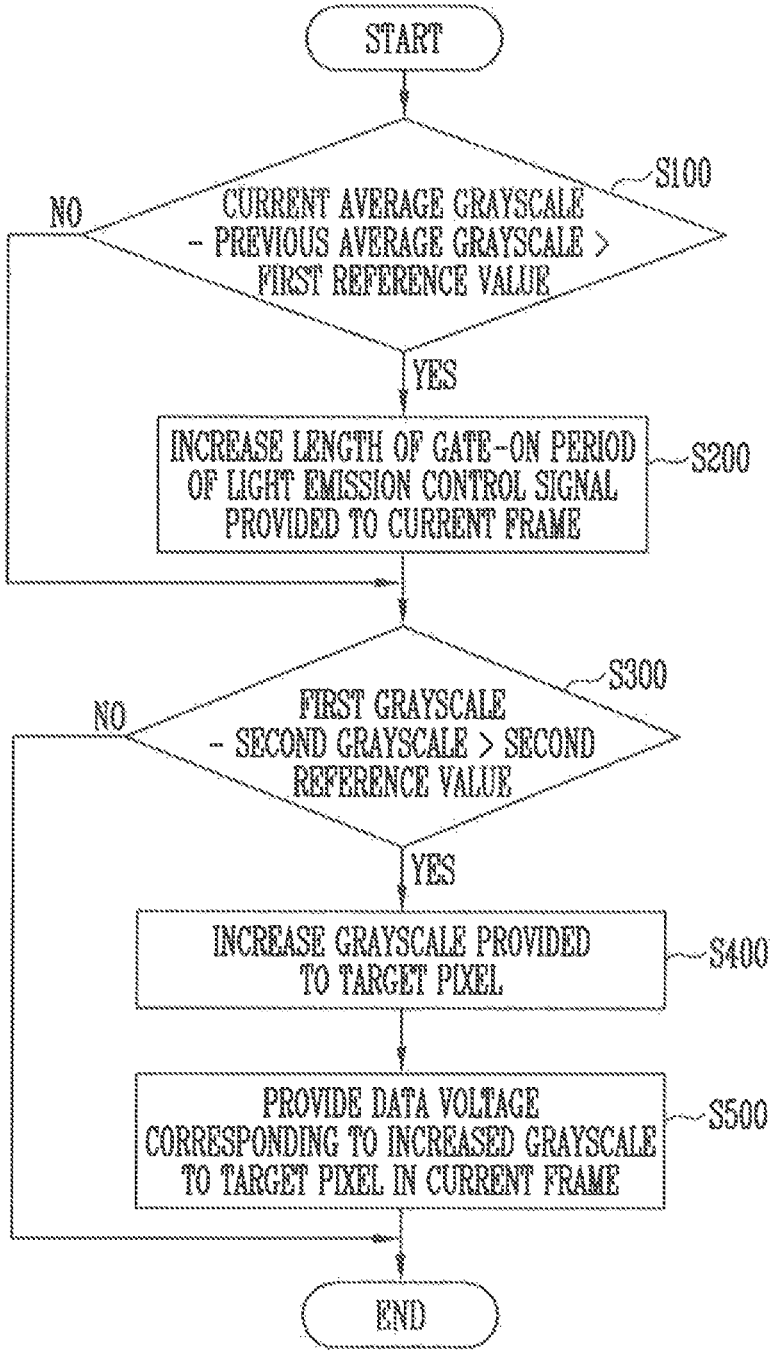
FIG. 10 is a flowchart illustrating a method of driving a display device according to an exemplary embodiment of the inventive concept.

FIG. 10 is a flowchart illustrating a method of driving a display device according to an exemplary embodiment of the inventive concept.

Referring to FIG. 10, the method of driving the display device may include comparing the average grayscale of the previous frame with the average grayscale of the current frame (S100), and increasing the length of the gate-on period of the light emission control signal provided to the current frame when an increase amount of the average grayscale of the current frame with respect to the average grayscale of the previous frame is greater than the predetermined first reference value (S200).

In addition, the method of driving the display device may include comparing the second grayscale of the previous frame with the first grayscale of the current frame (S300), increasing the first grayscale of the current frame when an increase amount of the first grayscale of the current frame with respect to the second grayscale of the previous frame is greater than the predetermined second reference value (S400), and providing the data voltage corresponding to the increased grayscale to the target pixel in the current frame (S500).

According to an exemplary embodiment of the inventive concept, the predetermined first reference value and the predetermined second reference value may be equal to each other or may be different from each other. However, as the method of driving the display device, which adjusts the light emission control signal and/or the grayscale value on the basis of a grayscale increase amount, has been described in detail with reference to FIG. 1 to FIG. 9, repetitive descriptions will be omitted.

As described above, the display device and the method of driving the same according to exemplary embodiments of the inventive concept may increase a charging time for a light emitting device by increasing the gate-on period of the light emission control signal at a time when the image is changed from a low grayscale to a high grayscale. In addition, the display device and the method of driving the same may charge the light emitting device faster by increasing the high grayscale at the time when the image is changed from the low grayscale to the high grayscale.

Therefore, the display device and the method of driving the same according to exemplary embodiments of the inventive concept may improve the grayscale conversion efficiency and the step efficiency of the image by increasing the charging time of the light emitting device or more rapidly charging the light emitting device at the time when the image is changed from the low grayscale to the high grayscale. As such, luminance reduction, image distortion, and color blurring due to the rapid image change may be minimized and image quality may be improved.

While the inventive concept has been shown and described with reference to exemplary embodiments thereof, it will be apparent to those of ordinary skill in the art that various changes in form and details may be made thereto without departing from the spirit and scope of the inventive concept as set forth by the appended claims.

What is claimed is:

1. A display device comprising:

a display panel including a pixel; and a panel driver configured to change a length of a gate-on period of a light emission control signal provided to the pixel in a current frame on the basis of a difference between a grayscale of a previous frame and a grayscale of the current frame, wherein the panel driver comprises:

a light emission period controller configured to increase the length of the gate-on period of the light emission control signal provided to the current frame when a first grayscale difference is greater than the predetermined first reference value, and wherein the first grayscale difference is obtained by subtracting a previous average grayscale, which is an average of grayscales of an image of the previous frame, from a current average grayscale, which is an average of grayscales of an image of the current frame.

2. The display device of claim 1, wherein the current average grayscale and the previous average grayscale are averages of grayscales corresponding to a k-th (where k is a natural number) pixel row.

3. The display device of claim 2, wherein the light emission period controller determines the length of the gate-on period of the light emission control signal provided to each pixel row on the basis of the first grayscale difference of a respective pixel row.

4. The display device of claim 1, wherein, in the same dimming luminance condition, the length of the gate-on period of the light emission control signal when the first grayscale difference is greater than the predetermined first reference value is longer than the length of the gate-on period of the light emission control signal when the first grayscale difference is less than or equal to the predetermined first reference value.

5. The display device of claim 1, wherein the current average grayscale is an average of all grayscales of the current frame, and the previous average grayscale is an average of all grayscales of the previous frame.

6. The display device of claim 1, wherein the panel driver further comprises:

a grayscale compensator configured to increase the grayscale of the current frame of the pixel to a compensation grayscale when a second grayscale difference is greater than a predetermined second reference value, and wherein the second grayscale difference is obtained by subtracting the grayscale of the previous frame of the pixel from the grayscale of the current frame.

7. The display device of claim 6, wherein, when a driving transistor included in the pixel is a p-type transistor, a magnitude of a data voltage provided to the pixel in the current frame decreases due to an increase of the grayscale of the current frame.

8. The display device of claim 7, wherein, when the grayscale of the current frame is the same as a grayscale of a next frame, a data voltage provided to the pixel in the next frame is greater than the data voltage provided to the pixel in the current frame.

9. The display device of claim 6, wherein, when the second grayscale difference is greater than the predetermined second reference value, the grayscale compensator applies a predetermined compensation coefficient to the grayscale of the current frame to increase the grayscale of the current frame.

10. The display device of claim 1, wherein the panel driver comprises:

a data driver configured to generate a data voltage corresponding to a grayscale and provide the data voltage to the pixel;

a scan driver configured to provide a scan signal to the pixel; and a light emission driver configured to provide the light emission control signal to the pixel.

11. A display device comprising:

a display panel including a pixel; and a panel driver configured to increase a grayscale corresponding to a current frame on the basis of a difference between a grayscale of a previous frame of the pixel and a grayscale of the current frame of the pixel, wherein the panel driver comprises:

a grayscale compensator configured to increase the grayscale of the current frame when a first grayscale difference is greater than the predetermined first reference value, and wherein the first grayscale difference is obtained by subtracting the grayscale of the previous frame of the pixel from the grayscale of the current frame of the pixel.

12. The display device of claim 11, wherein, when a driving transistor included in the pixel is a p-type transistor, a magnitude of a data voltage provided to the pixel in the current frame decreases according to an increase of the grayscale of the current frame.

13. The display device of claim 11, wherein the panel driver comprises:

a light emission period controller configured to increase a length of a gate-on period of a light emission control signal provided to the pixel in the current frame when a second grayscale difference is greater than a predetermined second reference value, and wherein the second grayscale difference is obtained by subtracting a previous average grayscale, which is an average of grayscales of an image of the previous frame, from a current average grayscale, which is an average of grayscales of an image of the current frame.

14. The display device of claim 13, wherein, in the same dimming luminance condition, the length of the gate-on period of the light emission control signal when the second grayscale difference is greater than the predetermined second reference value is longer than the length of the gate-on period of the light emission control signal when the second grayscale difference is less than or equal to the predetermined second reference value.

15. A method of driving a display device, the method comprising:

comparing a grayscale of a previous frame with a grayscale of a current frame; and increasing a length of a gate-on period of a light emission control signal provided to the current frame when a first increase amount of an average grayscale of an image of the current frame with respect to an average grayscale of an image of the previous frame is greater than a predetermined first reference value, wherein the average grayscale of the image of the current frame and the average grayscale of the image of the previous frame are averages of grayscales corresponding to a k-th (where k is a natural number) pixel row.

16. The method of claim 15, further comprising:

increasing a grayscale of the current frame of a target pixel when a second increase amount of the grayscale of the current frame of the target pixel with respect to a grayscale of the previous frame of the target pixel is greater than a predetermined second reference value; and providing a data voltage corresponding to the increased grayscale to the target pixel in the current frame.

17. The method of claim 16, wherein the increased grayscale is a compensation grayscale that is constant regardless of a value of the second increase amount.

* * * * *